US005823370A

United States Patent [19]

Ueda

[11] Patent Number: 5,823,370

[45] Date of Patent: Oct. 20, 1998

[54] MOVABLE RANGE INDICATING APPARATUS FOR MOBILE CRANE VEHICLE

[75] Inventor: Masamichi Ueda, Hiratsuka, Japan

[73] Assignees: Komatsu Ltd.; Komatsu Mec Kabushiki Kaisha, both of Tokyo, Japan

[21] Appl. No.: 894,981

[22] PCT Filed: Mar. 3, 1995

[86] PCT No.: PCT/JP95/00342

§ 371 Date: Sep. 2, 1997

§ 102(e) Date: Sep. 2, 1997

[87] PCT Pub. No.: WO96/27548

PCT Pub. Date: Sep. 12, 1996

[51] Int. Cl.[6] ..... B66C 23/04; G06G 7/00

[52] U.S. Cl. ..... 212/276; 364/424.045

[58] Field of Search ..... 212/231, 232, 212/276, 343; 73/862.381; 364/424.04, 478.18, 424.045, 424.058

[56] References Cited

FOREIGN PATENT DOCUMENTS

| | | |
|---|---|---|
| 55-56992 | 4/1980 | Japan . |
| 56-75393 | 6/1981 | Japan . |
| 62-111900 | 5/1987 | Japan . |
| 3-17759 | 3/1991 | Japan . |
| 3-67895 | 3/1991 | Japan . |
| 3-130291 | 12/1991 | Japan . |
| 5-58589 | 3/1993 | Japan . |
| 7-81886 | 3/1995 | Japan . |
| 7-81888 | 3/1995 | Japan . |
| 7-89697 | 4/1995 | Japan . |

*Primary Examiner*—William L. Oen
*Attorney, Agent, or Firm*—Sidley & Austin

[57] ABSTRACT

The present invention relates to a movable range indicating apparatus, for a mobile crane vehicle, which can easily display a movable range of a telescopic boom end and secure safety of a crane operation. To this end, the apparatus comprises a boom length detecting means (1), a boom angle detecting means (2), a turning position detecting means (3), a load detecting means (4), an operating condition inputting means (5), a display section (9) for indicating in rectangular coordinates, and a control section (8) for performing calculation or storage, and indicates by superimposition an image of a rated operating radius (23) and an image of an end position (24) of the telescopic boom on the display section. In addition, a target point (41) of the telescopic boom end can be indicated by superimposition.

20 Claims, 11 Drawing Sheets

MOVABLE RANGE INDICATING APPARATUS FOR MOBILE CRANE VEHICLE

TECHNICAL FIELD

The present invention relates to a movable range indicating apparatus for a mobile crane vehicle, and more particularly, to a movable range indicating apparatus for a telescopic boom end of a mobile crane vehicle.

BACKGROUND ART

Hitherto, mobile cranes have included a revolving superstructure, which has been provided on a self-movable base carrier; and a telescopic boom, which extends and contracts in a plurality of stages, has been mounted to the revolving superstructure. In addition, a hook is suspended from the distal end of the telescopic boom via a cable, and a crane operation is performed using the hook. When performing the crane operation, an operator is required to discern the condition of the telescopic boom at all times.

To this end, conventional movable range indicating apparatuses for mobile crane vehicles, etc., as shown in FIG. 19, adopt polar coordinates, in which a radial direction is taken as an operating radius or a load factor and a circumferential direction is taken as a turning angle (refer to, for example, Japanese Examined Patent Publication No. 3-17759, Japanese Unexamined Patent Publication No. 3-67895, and Japanese Unexamined Utility Model Publication No. 3-130291). According to these apparatuses, a rated operating radius, corresponding to a current actual lifting load, is calculated for each turning angle so as to be taken as the actual operating radius. In the above polar coordinates, a telescopic boom end position 61, obtained from the actual operating radius and the actual turning position, and a rated operating radius 62 (limit movable range) for each turning angle are indicated by superimposed images.

In general, however, since a sensation of the operator is formed on the basis of the rectangular coordinates, the sensation with respect to a rotary motion (angle) is often worse than the sensation with respect to a linear motion (distance). In other words, since the direction of the operating radius (back and forth) is taken as the linear motion, and the turning (left and right) direction is taken as the rotary motion in the polar coordinates, it is not easy to perceive the dangers in the turning direction as compared to the direction of the operating radius. In addition, it is quite remarkable that many accidents in the crane operation happen during turning. That is, according to the conventional art, one problem exists in that the angle is discerned as a measure when perceiving the dangers in the turning direction.

Further, most of the conventional apparatuses have an operation range limit function of moving the telescopic boom of the mobile crane vehicle to a desired position in order to set the movable range, and of sounding an alarm and of limiting the action of the telescopic boom when the end of the telescopic boom reaches the boundary of the movable range during the crane operation. For this reason, information about the movable range of the telescopic boom cannot be obtained from the indicating apparatus, and the operator cannot completely discern the operating radius and the turning range, so that there is a malfunction such that ensuring safety of the operation is hindered.

Next, another prior art apparatus has been known which subjects a crane to a simulation operation, allows a movable range of a revolving superstructure including an operating machine to be stored, and suspends the operation of the crane and gives a warning based on the stored information (refer to, for example, Japanese Unexamined Patent Publication No. 56-75393). Further, according to an indicating apparatus put into practical use (refer to, for example, Japanese Unexamined Patent Publication No. 5-58589), as shown in FIG. 20, a limit movable range 63 and a telescopic boom end position 64 are indicated by superimposition, taking the X-coordinate a as the operating radius and the Y-coordinate b as the lift of the telescopic boom.

However, when the crane is subjected to the simulation operation by the described arrangements to set the movable range, the setting is usually performed without a load being suspended, but the rated operating radius is changed by a lifting load in a load suspending operation. Therefore, even within the limited movable range, the boom may be overloaded, depending upon the lifting load. That is, since a region where the boom is overloaded cannot be discerned from the movable range indicated image of the above prior art, there arises a problem in that a suitable advance measure for the prevention of the dangers cannot be taken.

SUMMARY OF THE INVENTION

The present invention has been made to solve the problems of the prior art, and its object is to provide a movable range indicating apparatus, for a mobile crane vehicle, which can easily and accurately display a movable range of a telescopic boom end, and ensure safety of a crane operation.

In a first aspect of a movable range indicating apparatus for a mobile crane vehicle according to the present invention, there is provided a movable range indicating apparatus comprising: a boom length detecting means; a boom angle detecting means; a load detecting means; a turning position detecting means; an operating condition inputting means for inputting operating conditions of a revolving superstructure and a base carrier and/or an operating condition detecting means for detecting the operating conditions; a display section capable of indicating images in rectangular coordinates, in which the turning position is taken as the X-coordinate and an operating radius is taken as the Y-coordinate; and a control section for performing calculations based on signals from each of the means, and for outputting the calculation results to the display section; wherein the control section calculates a current actual load, a rated operating radius for each turning position in a state of suspending the actual load, and an end position of a telescopic boom; and wherein the display section indicates an image of the rated operating radius and an image of the end position of the telescopic boom at the corresponding positions on the rectangular coordinates by superimposition. In addition, a target point setting means for setting the target point of the telescopic boom can be attached, and the target point can be indicated on the display section by superimposition. Further, the target point and its neighborhood can be indicated on the display section under enlargement.

By the described arrangements, the rated operating radius for each turning angle, with respect to the current lifting load, and the current telescopic boom end position are indicated by superimposition on the display section of rectangular coordinates, where the turning position is taken on the X-coordinate and the operating radius is taken on the Y-coordinate, whereby an operator can make an accurate judgment. In addition, when indicating the target point by superimposition, the location of the rated operating radius in relation to the target point is determined at the time of separating the load from the ground (immediately after initially lifting the load). Therefore, at the time of separating the load from the ground, depending on the fact of whether the target point is located on the inside or on the outside of the operating radius, it can be judged whether or not the boom can reach the target point without being overloaded. Moreover, an operation stroke of the boom before reaching the target point can also be immediately discerned from the indicated image. Further, when indicating the neighborhood of the target point under enlargement, the boom can be accurately adjusted to the target point.

In a second aspect of a movable range indicating apparatus for a mobile crane vehicle according to the present invention, there is provided a movable range indicating apparatus comprising: a boom length detecting means; a boom angle detecting means; a load detecting means; a movable range setting means; a turning position detecting means; an operating condition inputting means for inputting operating conditions of a revolving superstructure and a base carrier and/or an operating condition detecting means for detecting the operating conditions; a display section capable of indicating images in rectangular coordinates, in which a turning angle is taken as the X-coordinate and an operating radius is taken as the Y-coordinate; and a control section for performing calculations based on signals from each of the means, and for outputting the calculation results to the display section; wherein the control section calculates a current actual load, a rated operating radius for each turning position in a state of suspending the actual load, a limit operating radius obtained by comparing the rated operating radius with an operating radius limit value based on the movable range setting means, and an end position of a telescopic boom; and wherein the display section indicates an image of either the rated operating radius or the limit operating radius, and an image of the end position of the telescopic boom at the corresponding positions on the rectangular coordinates by superimposition.

By the described arrangements, the end position of the telescopic boom is indicated and, at the same time, the rated operating radius determined by the current suspended load, and the limited movable range, or the smaller one of the rated operating radius and the movable range is indicated by superimposition over the entire turning area, so that a safe operable range of the boom can be discerned.

In a third aspect of a movable range indicating apparatus for a mobile crane vehicle according to the present invention, there is provided a movable range indicating apparatus comprising: a boom length detecting means; a boom angle detecting means; a load detecting means; an operating condition inputting means for inputting operating conditions of a revolving superstructure and a base carrier and/or an operating condition detecting means for detecting the operating conditions; a movable range setting means capable of setting movable ranges for at least the lift of a telescopic boom, the operating radius, and the telescopic boom derricking angle; a display section capable of indicating images in rectangular coordinates, in which the operating radius is taken as the X-coordinate and the lift of the telescopic boom is taken as the Y-coordinate; and a control section for performing calculations based on signals from each of the means, and for outputting the calculation results to the display section; wherein the control section calculates an actual load in a current attitude of the telescopic boom, a rated operating radius under the actual load, and an end position of the telescopic boom; and wherein the display section indicates an image of the end position of the telescopic boom, an image of the movable range, and an image of the rated operating radius at the corresponding positions on the rectangular coordinates by superimposition. In addition, a cable length detecting means and a hook lift calculating means, for calculating the lift of a hook based on a signal from the cable length detecting means, can be attached, and the lift position of the hook can be indicated on the display section by superimposition.

By the described arrangements, the rated operating radius due to the current lifting load, the limited movable range, and the telescopic boom end position are indicated by superimposition of images on the rectangular coordinates, whereby the operator can intuitively and accurately discern the movable range of the crane in raising, lowering, extending, and contracting operations of the crane, even if the boom is overloaded within the limited movable range of the crane. In addition, by indicating the hook lift position by superimposition, the situations of the movable range and the suspended load can be discerned simultaneously.

In a fourth aspect of a movable range indicating apparatus for a mobile crane vehicle according to the present invention, there is provided a movable range indicating apparatus comprising: a boom length detecting means; a boom angle detecting means; a turning position detecting means; a load detecting means; a movable range setting means; a display section capable of indicating images in polar coordinates, in which the turning angle is taken in the circumferential direction and the operating radius is taken in the radial direction; and a control section for performing calculations based on signals from each of the means, and for outputting the calculation results to the display section; wherein the control section calculates a current actual operating radius, a current actual load, a rated operating radius for each turning position in a state of suspending the actual load, and a limit operating radius obtained by comparing the rated operating radius with an operating radius limit value set by the movable range setting means; and wherein the display section indicates the actual operating radius and the limit operating radius at the corresponding positions on the polar coordinates by superimposition. In addition, a target point setting means for setting the target point of the telescopic boom end can be attached, and the target point can be indicated on the display section by superimposition.

The described arrangement of the fourth aspect adopts the indication in the polar coordinates, while the rectangular coordinates are adopted in the above third aspect, whereby the same action and effect as those of the third aspect can be obtained.

BRIEF DESCRIPTION OF DRAWINGS

FIGS. 8A and 8B are drawings of a case where a part of the indicated image of FIG. 7 is enlarged, in which FIG. 8A is an illustration of an extended object range, and FIG. 8B is an illustration of an example of an enlargement of a portion of the indication;

FIGS. 16 to 18 are drawings according to the third embodiment which show changes in the movable range with respect to different suspended loads, in which FIG. 16 is an illustration of a case where the suspended load is a medium load; FIG. 17 is an illustration of a case where the suspended load is a light load; and FIG. 18 is an illustration of a case where the suspended load is a heavy load;

BEST MODE FOR CARRYING OUT THE INVENTION

The preferred embodiments of a movable range indicating apparatus for a mobile crane vehicle according to the present invention will be described in detail with reference to the attached drawings.

Figure 1:
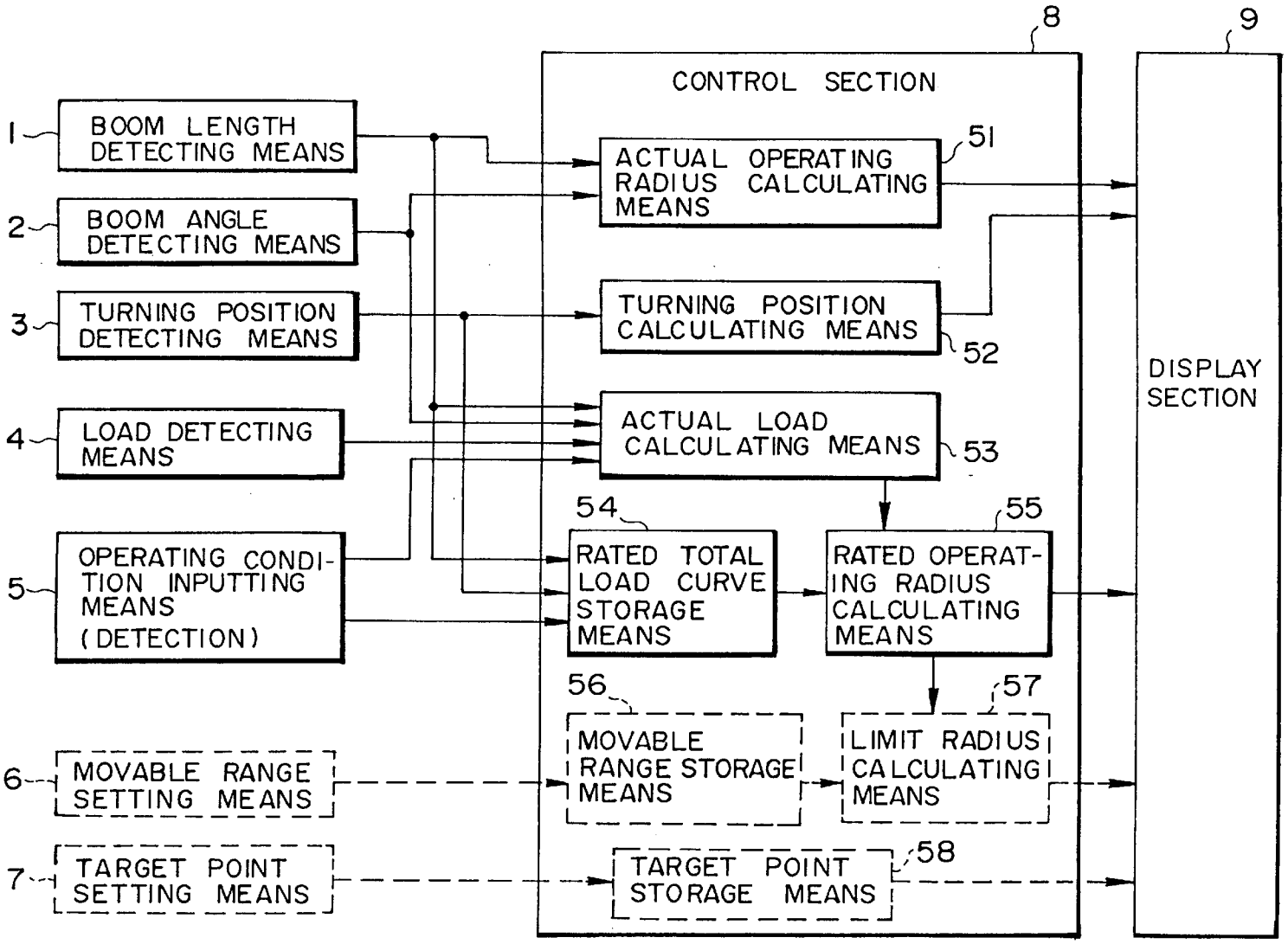
FIG. 1 is a system block diagram of a movable range indicating apparatus according to a first embodiment of the present invention.

FIG. 1 illustrates a movable range indicating apparatus according to a first embodiment, which is roughly composed of various means for performing detection, etc., a control section 8, and a display section 9. Each of the means for performing detection comprises a detecting means or an inputting means, such as a boom length detecting means 1, a boom angle detecting means 2, a turning position detecting means 3, a load detecting means 4, and an operating condition inputting means (or an operating condition detecting means 5. In addition, a movable range setting means 6 and/or a target point setting means 7 can be included as necessary.

The above operating condition inputting (or detecting) means 5 is used for setting an operating condition before starting a crane operation, and inputs (or detects) operation modes of a revolving superstructure and a base carrier. For example, as regards the revolving superstructure, any one of boom, single top, and jib operations can be selected and inputted. In the boom operation, the number of falls of a wire cable for a load suspending hook can be inputted in addition to a normal boom operation. On the other hand, as regards the base carrier, any one of outrigger, on-tire, and suspending travel operations can be selected and inputted. When selecting the outrigger operation, an outrigger projecting width is automatically inputted and set by an outrigger length detecting means.

The above movable range setting means 6 is used for limiting the movable range in the crane operation, and sets the movable range responsive to an obstacle, etc. The setting is selected, depending on a limitation of the selected one of the crane operations, such as boom angle upper/lower limit, operating radius, boom height, boom length, and turning angle operations, and is set by a setting switch. The setting method is performed by moving a crane vehicle in advance to an operating position to be controlled, and at that position, by pushing the setting switch corresponding to the operation to be limited. This allows the applicable operational limitation in the crane operation to be stored in a movable range storage means 56 to be described later. Incidentally, the movable range setting means can include a means for setting the range one-dimensionally or three-dimensionally.

The setting of the above target point setting means 7 is performed by moving the crane vehicle to a predetermined operating position, by moving the boom to a target point at that position, and by pushing the setting switch. The set items, such as the operating radius and the turning position, the lift of the hook or the lift of the boom, as necessary, are stored in a target point storage means 58, to be described later.

In addition, the control section 8 comprises an actual operating radius calculating means 51, a turning position calculating means 52, an actual load calculating means 53, a rated total load curve storage means 54, and a rated operating radius calculating means 55. Further, a movable range storage means 56, a limit radius calculating means 57, and/or a target point storage means 58 can be included as necessary.

The actual operating radius calculating means 51 calculates the actual operating radius based on the boom length and the boom angle, inputted from the boom length detecting means 1 and the boom angle detecting means 2. In addition, the turning position calculating means 52 calculates the turning position from the detected value of the turning position detecting means 3. The above actual operating radius and the turning position become an end position of the telescopic boom, and are inputted to the display section 9. The actual load calculating means 53 calculates the current actual load based on the boom length, the boom angle, the load, and the operating condition, obtained from the boom length detecting means 1, the boom angle detecting means 2, the load detecting means 4, and the operating condition inputting (or detecting) means 5, and outputs the actual load to the rated operating radius calculating means 55. Further, the rated total load curve storage means 54 selects the applicable rated total load curve from the previously stored rated total load curves based on the boom length, the turning position, and the operating condition, obtained from the boom length detecting means 1, the turning position detecting means 3, and the operating condition inputting (or detecting) means 5, and outputs it to the rated operating radius calculating means 55. The rated operating radius calculating means 55 calculates the rated operating radius from the actual load and the rated total load curve, and outputs it to the display section 9.

The movable range storage means 56, which can be included as necessary, outputs the movable range (in this embodiment, the movable range with respect to the operating radius and the turning angle) set by the movable range setting means 6 to the limit radius calculating means 57. Incidentally, in the turning angle range where turning is impossible, the movable range is outputted as a range having no movable range of the operating radius, i.e., as "0". Next, the limit radius calculating means 57 compares the rated operating radius with the movable range for each turning position, and outputs the smaller one as the limit radius to the display section 9. That is, the limit radius calculating means 57 obtains an "AND region" between the rated operating radius and the movable range. In this case, an output from the rated operating radius calculating means 55 to the display section 9 is not performed. Incidentally, the rated operating radius, from the rated operating radius calculating means 55, and the movable range, from the movable range storage means 56, can be outputted to the display section 9 without performing calculation or including the limit radius calculating means 57. Further, the target point storage means 58, which can be included as necessary, outputs the target point from the target point setting means 7 to the display section 9.

Figure 2:
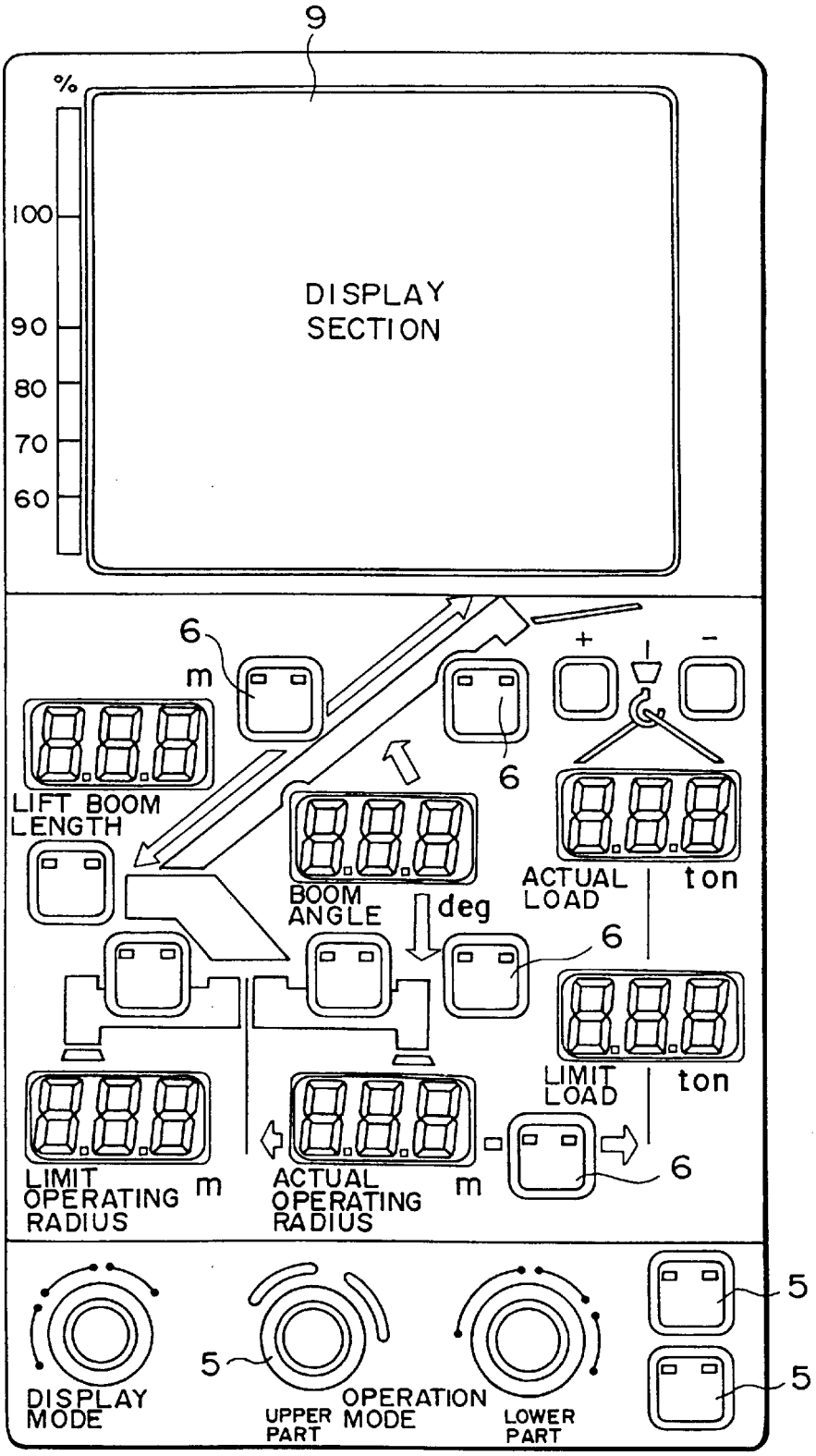
FIG. 2 is an external view of the movable range indicating apparatus, according to the first embodiment, in which an operating condition inputting (or detecting) means, a movable range setting means, an indicator for detected values from each of the means, and a display section, comprising a multidisplay, are combined in a single unit.

FIG. 2 illustrates an example of the movable range indicating apparatus which comprises an operating condition inputting (or detecting) means 5 for inputting (or detecting) operation modes of the revolving superstructure and the base carrier, a switch-type movable range setting means 6 for setting a boom length and boom angle upper limit/lower limits, etc., and a display section 9 of multidisplay.

Examples of indication of the movable range by the described arrangements will be described.

Figure 3:
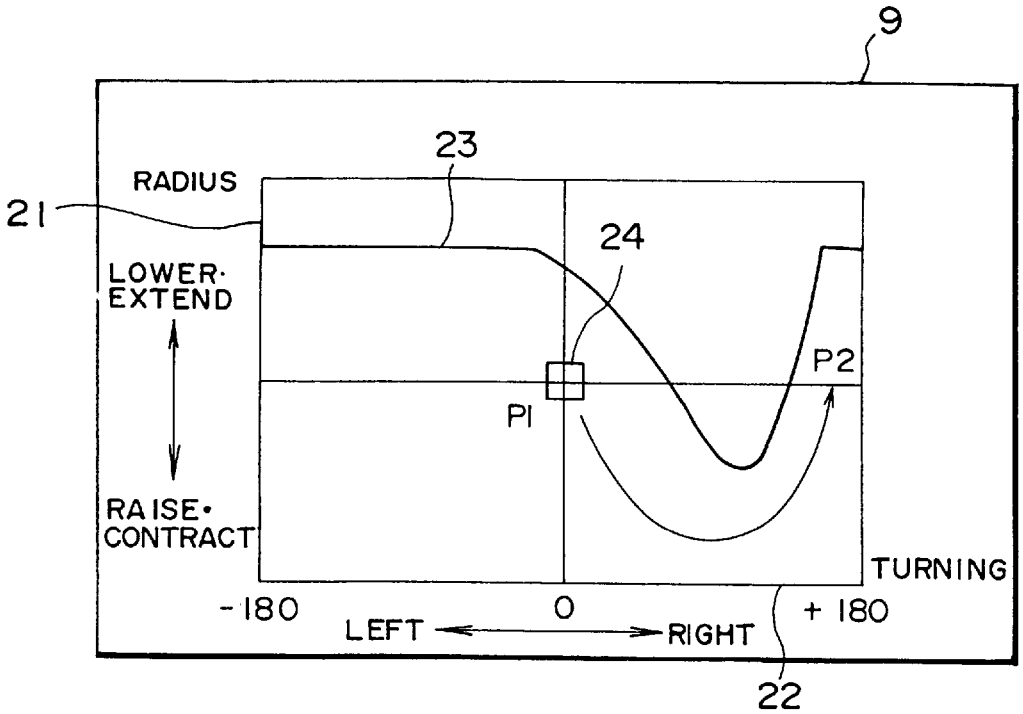
FIG. 3 is an illustration of the display section, according to the first embodiment, which indicates by superimposition a boom end position and a rated operating radius on the bases of a revolving superstructure in rectangular coordinates.

FIG. 3 indicates a rated operating radius 23 and a telescopic boom end position 24 by superimposition, using the revolving superstructure (in this embodiment, the front of an operator) as the origin. Incidentally, the present coordinate system is rectangular coordinates in which the X-coordinate 22 is taken as the turning position (turning angle) and the Y-coordinate 21 is taken as the operating radius. In addition, the turning angle indicating range is not limited to the whole circumference (from −180° to +180°), but can be partial, for example, from −90° to +90°. The indication is on an operator basis, and the operator can accurately and easily discern the movable range of the crane.

Figure 4:
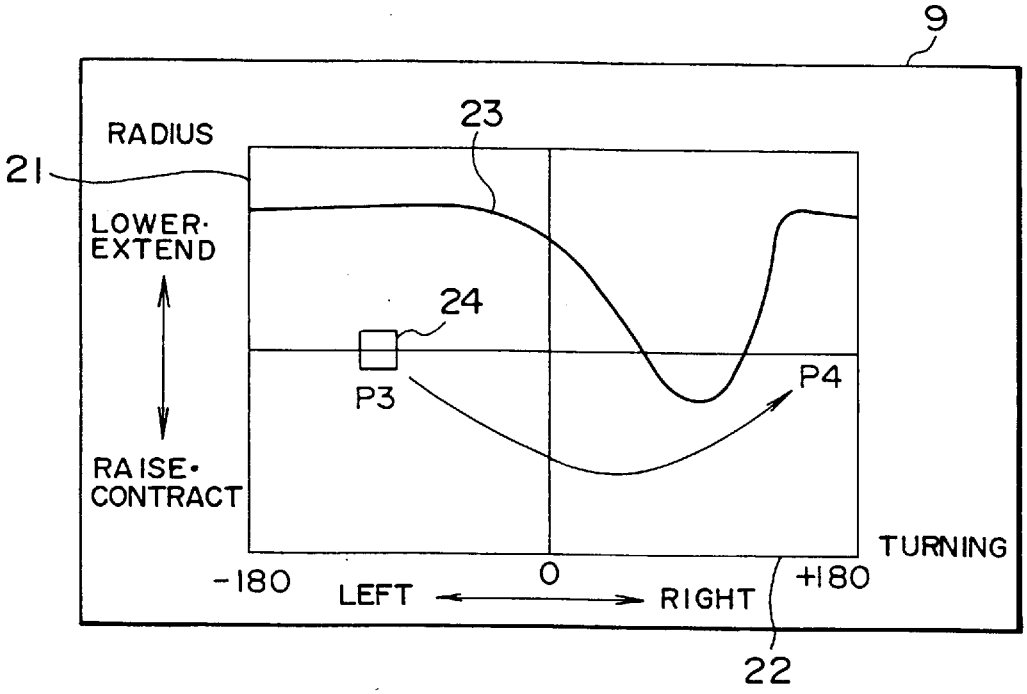
FIG. 4 is an illustration of the display section in which a base carrier is the basis in contrast with FIG. 3.

FIG. 4 indicates the rated operating radius 23, and the telescopic boom end 24 by superimposition on the basis (origin) of the base carrier. In the case of this indication, the direction of the revolving superstructure with respect to the base carrier can be easily discerned.

In addition, as shown in FIGS. 3 and 4, when moving from position P1 to position P2, and from position P3 to position P4, respectively, it can be obviously read from the indicated image that, while turning rightwardly, the operator can raise the boom once to keep away from a dangerous area and then can perform a lowering operation again.

Figure 5:
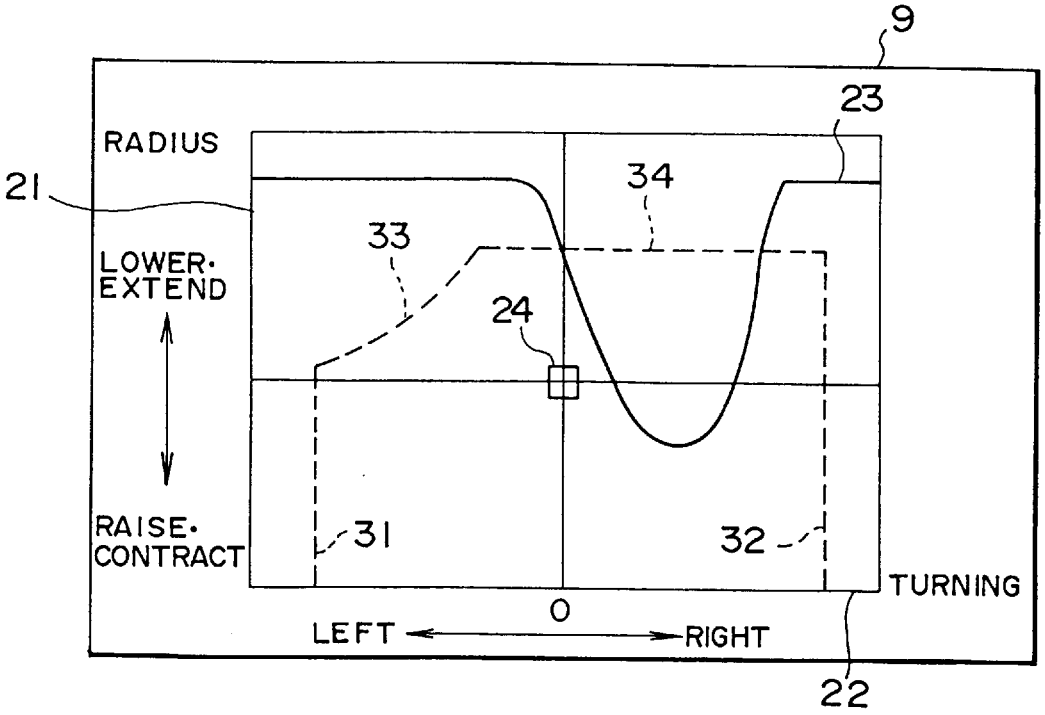
FIG. 5 is an illustration of a case where a movable range is indicated by superimposition on the corresponding position of FIG. 3.

FIG. 5 shows a case where a movable range from the movable range storage means 56 is indicated by superimposition on the corresponding position of the rectangular coordinates of FIG. 3. This movable range is indicated with a left-turning limit 31, a right-turning limit 32, a radius-turning composite limit 33, and a radius limit 34.

Figure 6:
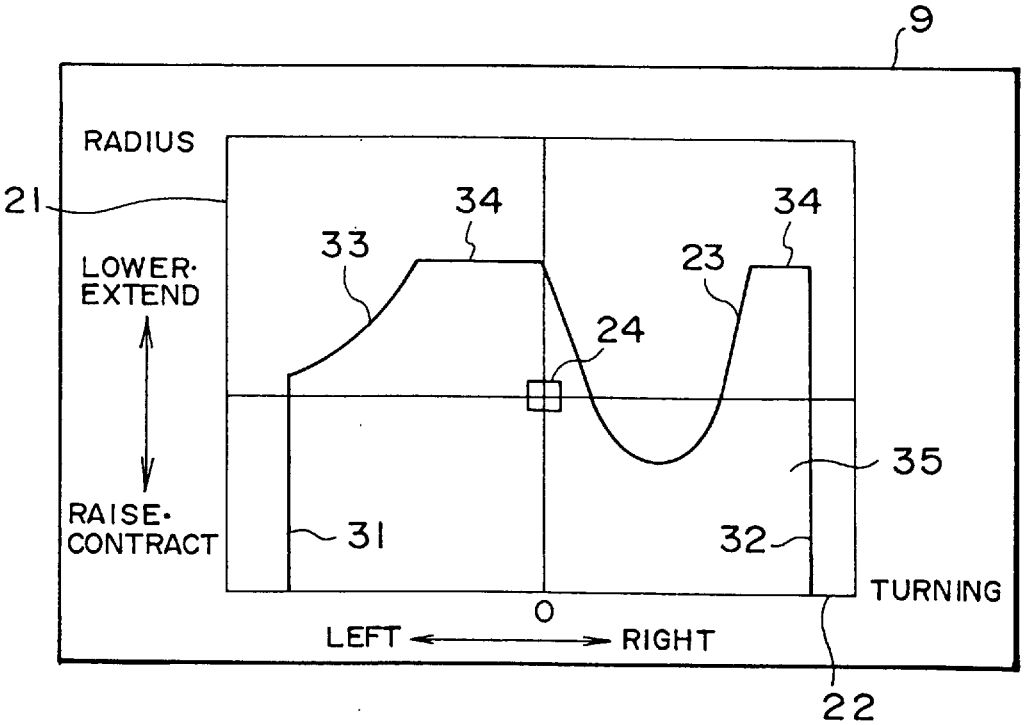
FIG. 6 is an illustration of the display section, according to the first embodiment, which indicates by superimposition a boom end position and a limit operating radius on the basis of the revolving superstructure in the rectangular coordinates.

FIG. 6 is an example which indicates an "AND region" between the rated operating radius 23 and the above movable range, i.e., a limit radius region 35 obtained by the limit radius calculating means 57 (see FIG. 1). It is apparent from this example of indication that the operator can easily perform the operation of the telescopic boom end position 24 with safety.

Figure 7:
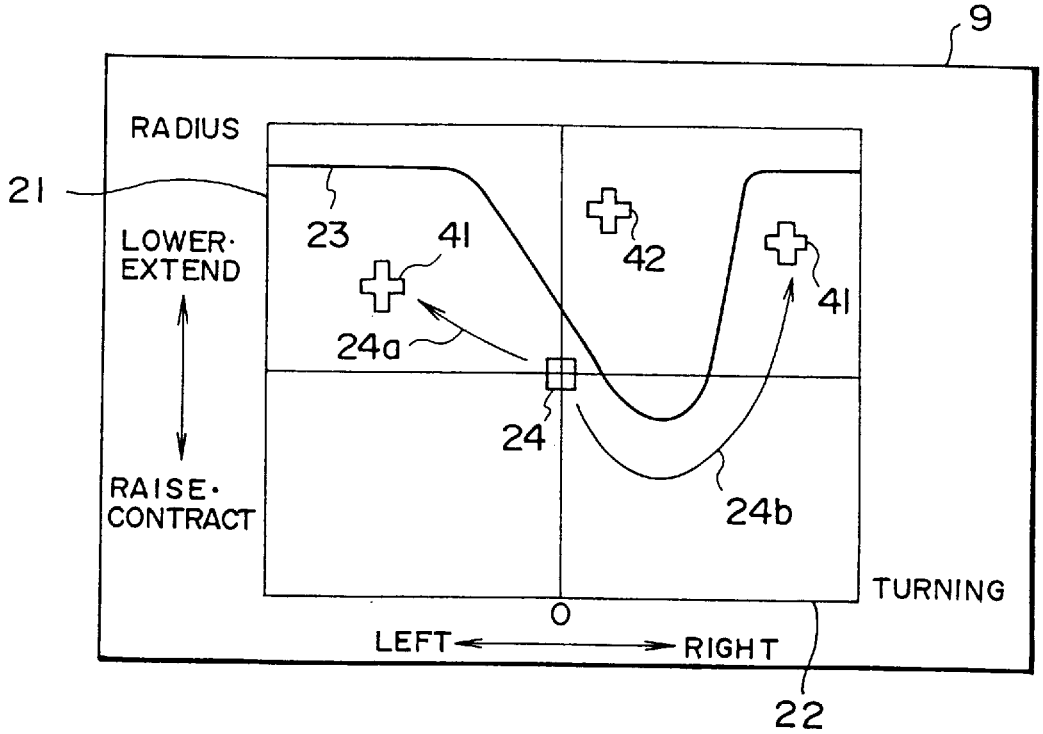
FIG. 7 is an illustration of a case where a target point is indicated by superimposition on the corresponding position of FIG. 3.

FIG. 7 is an example in which a target point 41, based on the operating radius and the turning angle of the target point storage means 58 (see FIG. 1), is indicated by superimposition on the corresponding position of the rectangular coordinates of FIG. 3. The number of target points 41 can be more than one, as necessary. By such a displayed image, a safe moving stroke from the present telescopic boom end 24 to the target point 41 can immediately be judged by viewing a screen. That is, it is understood that the operations can be done as indicated by arrows 24*a*, 24*b*. In addition, when a lifting load is different, for example, it can be judged that the boom is overloaded at the target point 42 or in the moving stroke immediately after the load has been separated from the ground, so that a suitable and prompt measure, such as suspension of operation, can be taken.

Figure 8A:
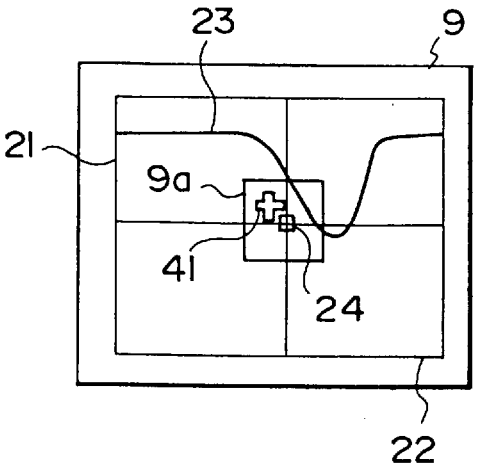
Figure 8B:
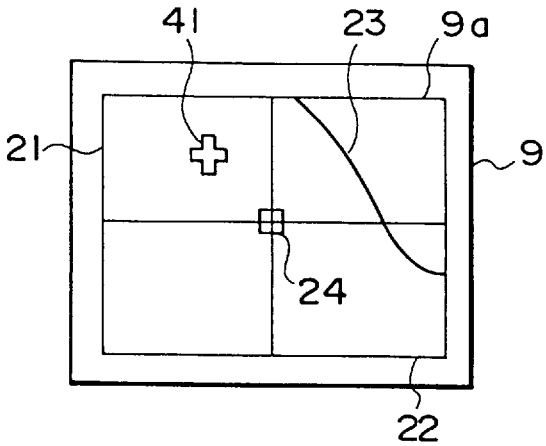

FIGS. 8A and 8B are examples in which an extended object range 9*a* is indicated under enlargement. The indication under enlargement is useful for a case where the telescopic boom end 24 cannot be seen due to an obstacle such as a wall. That is, when the telescopic boom end 24 approaches the target point 41, a detailed position can be discerned by enlarging a portion of the extended object range 9*a*, so that an accurate operation can be performed. Incidentally, such a function would be difficult in a polar coordinates indication system.

As described above in detail, similar to the direction of the operating radius, the operator can also discern the movable range of the crane and the telescopic boom end position regarding the turning direction with a sense of distance. Moreover, the up, down, left, and right directions in which the telescopic boom moves on the image are in correspondence with the back, forth, left, and right operating directions of the crane, so that they can be discerned intuitively, and at the same time they are very useful for ensuring safety of the crane operation.

Next, a second embodiment of a movable range indicating apparatus for a mobile crane vehicle according to the present invention will be described with reference to the attached drawing.

Figure 9:
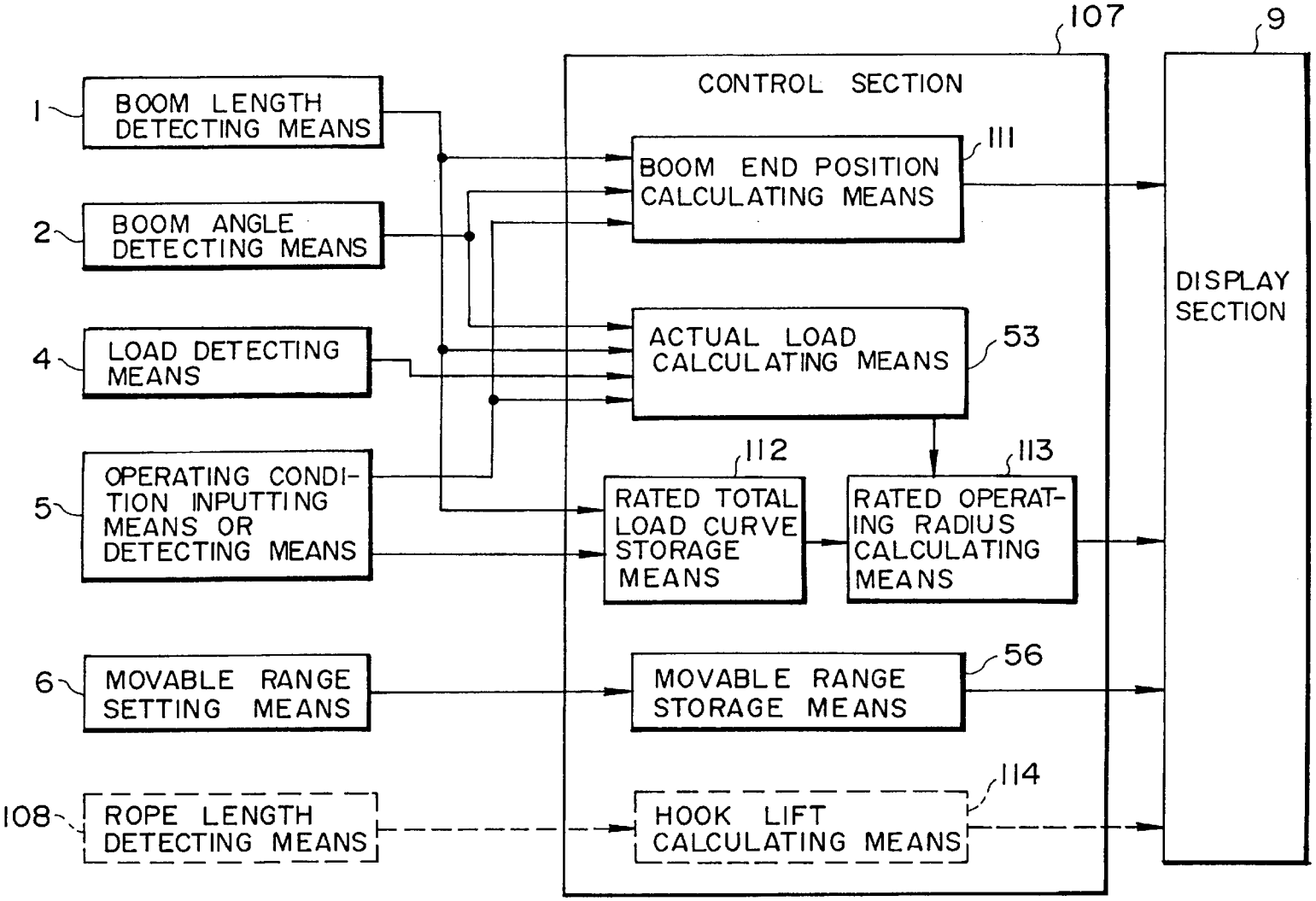
FIG. 9 is a system block diagram of a movable range indicating apparatus according to a second embodiment of the present invention.

Referring to FIG. 9, the movable range indicating apparatus of this embodiment is roughly composed of various detecting means, a control section 107, and a display section 9, and has a basic configuration similar to that of FIG. 1. The detecting means can be composed of a boom length detecting means 1, a boom angle detecting means 2, a load detecting means 4, an operating condition inputting (or detecting) means 5, a movable range inputting means 6, and a cable length detecting means 108, as necessary.

The control section 107 comprises a means for calculating or storing, based on information from each of the above detecting means. A boom end position calculating means 111 calculates the boom end position based on the boom length, the boom angle, and the operating condition from the boom length detecting means 1, the boom angle detecting means 2 and the operating condition inputting (or detecting) means 5, and outputs it to the display section 9. An actual load calculating means 53 calculates the actual load similar to the first embodiment. A rated total load curve storage means 112 selects the applicable rated total load curve from the previously stored rated total load curves based on the values from the boom length detecting means 1 and the operating condition inputting (or detecting) means 5, and outputs it to a rated operating radius calculating means 113.

The above rated operating radius calculating means 113 calculates the rated operating radius from the actual load of the actual load calculating means 53 and the rated total load of the rated total load curve storage means 112, and outputs it to the display section 9. Although a movable range storage means 56 stores the movable range similar to the first embodiment, it outputs the movable range directly to the display section. In addition, a hook lift calculating means, included as necessary, calculates the hook lift position based on the cable length from the cable length detecting means 108 to output directly to the display section 9. The external appearance of the movable range indicating apparatus constructed as described above is the same as that of FIG. 2.

Figure 10:
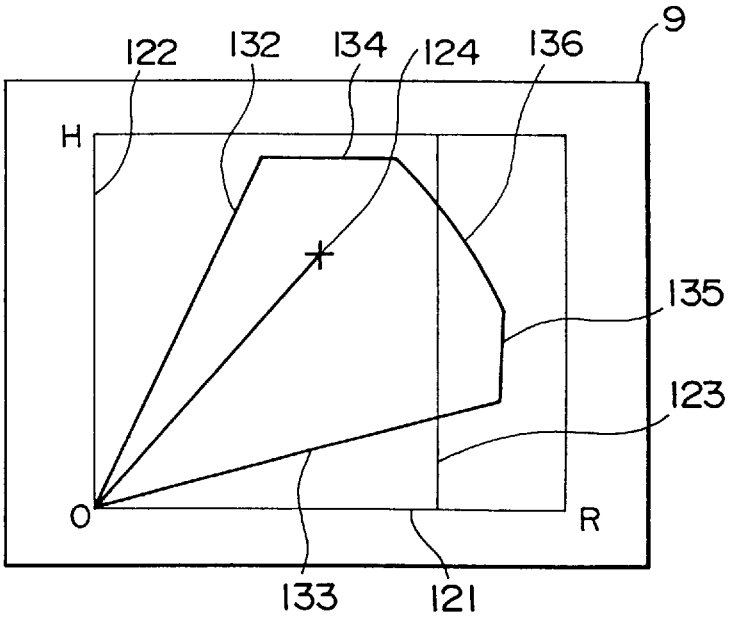
FIG. 10 is an illustration of a display section, according to the second embodiment, which indicates by superimposition a movable range, a boom end position, and a rated operating radius in rectangular coordinates.
Figure 11:
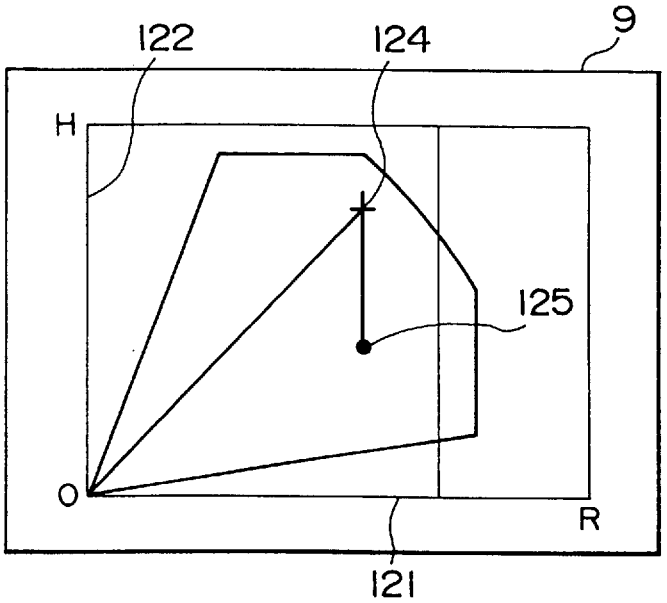
FIG. 11 is an illustration of the display section which indicates a hook lift position by superimposition on FIG. 10.

An example of indication of the movable range by the described arrangements will be described. FIG. 10 illustrates the display section 9 of rectangular coordinates in which the operating radius is taken as the X-coordinate 121 and the lift of the telescopic boom is taken as the Y-coordinate 122. The movable range is indicated on the display section 9 by a boom angle upper limit 132, a boom angle lower limit 133, a lift limit 134, an operating radius limit 135, and a boom length limit 136 outputted from the movable range storage means 56, and at the same time a boom end position 124 and a rated operating radius 123, due to the present lifting load, are indicated by superimposition. For example, it can be judged that the boom is overloaded when the boom end position 124 goes across the rated operating radius 123 due to a lowering operation of the boom. FIG. 11 indicates a hook lift position 125 by superimposition on FIG. 10, so that the movable range of the boom and the situation (height, etc.) of a suspended load can be discerned simultaneously. Therefore, in this embodiment, steps can be taken to avoid a dangerous condition, whereby safety of the crane operation is ensured.

Next, a third embodiment, of a movable range indicating apparatus for a crane vehicle according to the present invention, will be described with reference to the attached drawings. In this embodiment, an image is indicated in polar coordinates, while the image is indicated in rectangular coordinates in the first embodiment. Therefore, each of the detecting means, the control section (calculating or storage means), and the display section (multidisplay) are the same as those of FIGS. 1 and 2.

Figure 12:
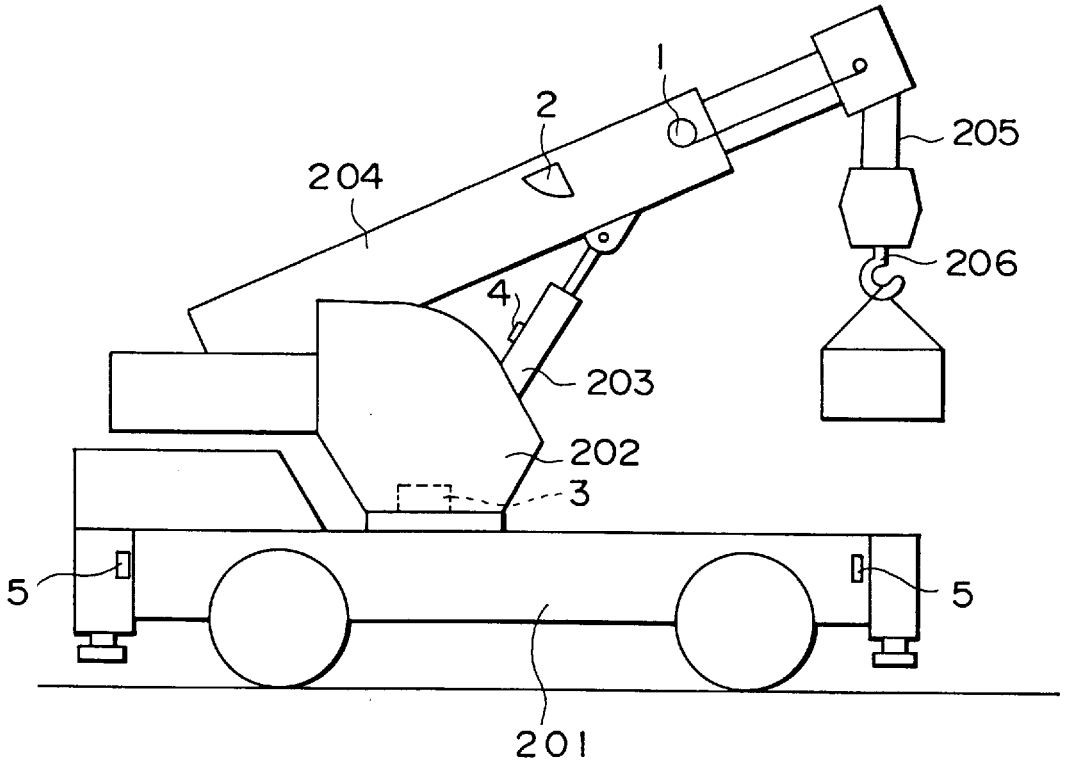
FIG. 12 is a side view of a mobile crane vehicle to which a movable range indicating apparatus, according to a third embodiment of the present invention, is applied.

Referring to FIG. 12, a revolving superstructure 202 is revolvably provided on a self-movable base carrier 201, and a telescopic boom 204, which is vertically swingable due to a boom cylinder 203, is mounted to the revolving superstructure 202. The above telescopic boom 204 can extend and contract in a plurality of stages, and a hook 206 is suspended from the tip thereof by a cable 205. In addition, the telescopic boom 204 is provided with a boom length detecting means 1, for detecting the extension length, and a boom angle detecting means 2, for detecting the angle of the telescopic boom 204. In addition, a turning section of the revolving superstructure 202 is provided with a turning position detecting means 3, the boom cylinder 203 is provided with a load detecting means 4, and operating condition inputting (or detecting) means 5 are provided across the base carrier 201. The operating condition inputting (or detecting) means 5 in this embodiment adds a function of detecting the projecting and installation conditions of the outriggers to the first embodiment. Incidentally, this addition can be performed with respect to the above second embodiment.

In addition, a movable range setting means 6 and, as necessary, a target point setting means 7 are included in addition to the above detecting means 1 to 5. Information from these means 1 to 7 is inputted to a control section 8, shown in FIG. 1, to be calculated or stored, and outputted to the display section 9. On this display section 9, the image is indicated in polar coordinates as described above.

Examples of indication of the movable range by the described arrangements will be described.

Figure 13:
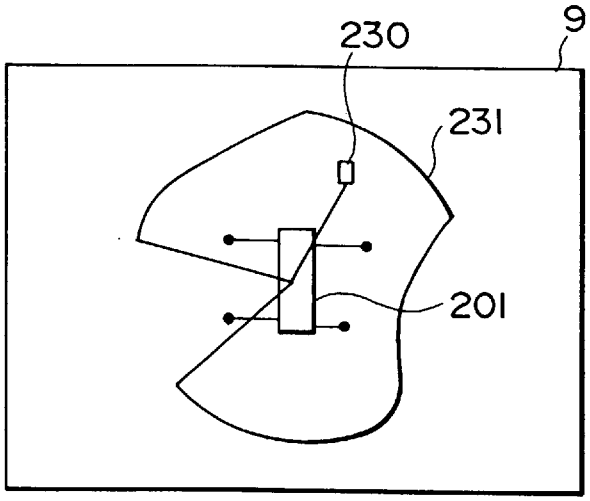
FIG. 13 is an illustration of a display section, according to the third embodiment, which indicates by superimposition a limit operating radius and an actual operating radius on the basis of the base carrier in polar coordinates.

FIG. 13 shows the polar coordinates in which the operating radius is taken in the radial direction and the turning angle is taken in the circumferential direction, and the base carrier 201, which becomes the basis, is indicated so as to face upwardly on the screen at all times. Numeral 230 denotes an actual operating radius (and an actual turning position), and numeral 231 denotes a limit operating radius with respect to the current load.

Figure 14:
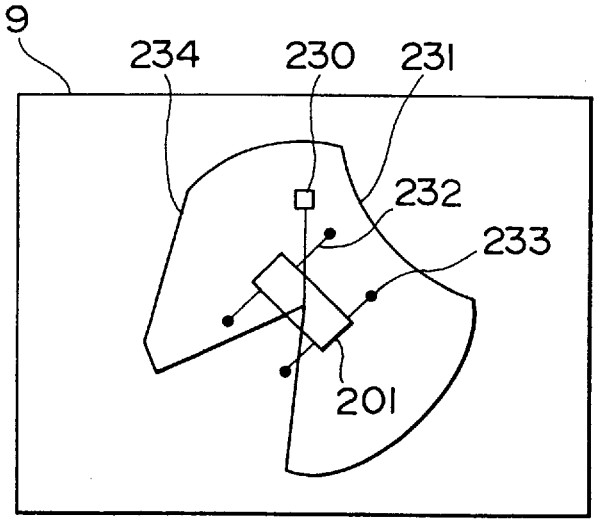
FIG. 14 is an illustration of the display section in which a revolving superstructure is the basis in contrast with FIG. 13.

On the other hand, in FIG. 14, the revolving superstructure 202, which becomes the basis, is indicated so as to face upwardly on the screen at all times. Numeral 232 denotes a projecting condition of the outriggers, and numeral 233 denotes an installation condition of the outriggers. In addition, regarding round marks illustrated at the tips, black dots show a grounding condition and open circles show a floating condition, for example. By indicating the projecting condition of the outriggers and grounding condition together with a radius-turning composite range limit 234 by superimposition, the movable range of the telescopic boom 204 can be discerned under direct vision.

Figure 15:
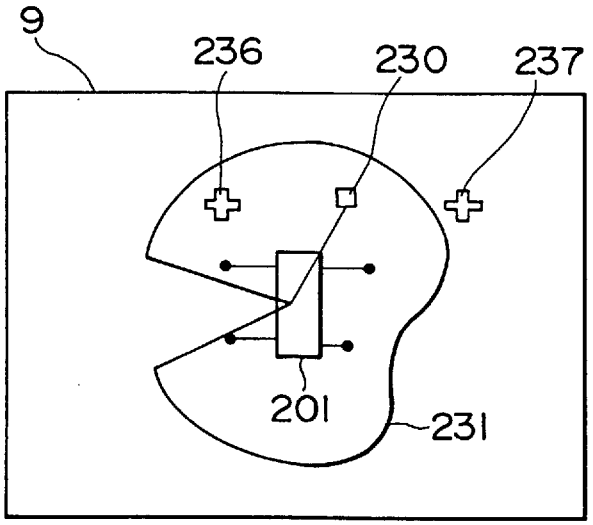
FIG. 15 is an illustration of the display section which indicates target points by superimposition on FIG. 13.

FIG. 15 illustrates a case where target points 236 and 237 are indicated by superimposition. By this, immediately after the suspended load has been separated from the ground, it can be judged whether or not the target points are within the movable range of the telescopic boom 204, so that the crane operation can be efficiently performed. Although the target point 236 shows the movable range, the target point 237 shows that the boom is overloaded, whereby a suitable measure, such as suspension of the operation, is taken. Such an indication is useful particularly for a blind operation and a repetitive operation, etc.

Figure 16:
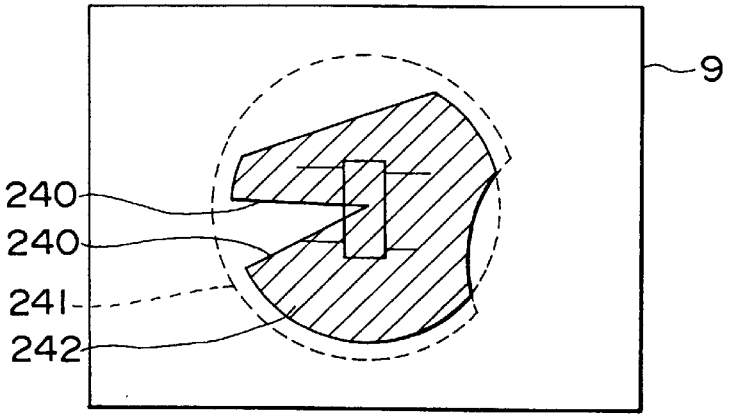
Figure 17:
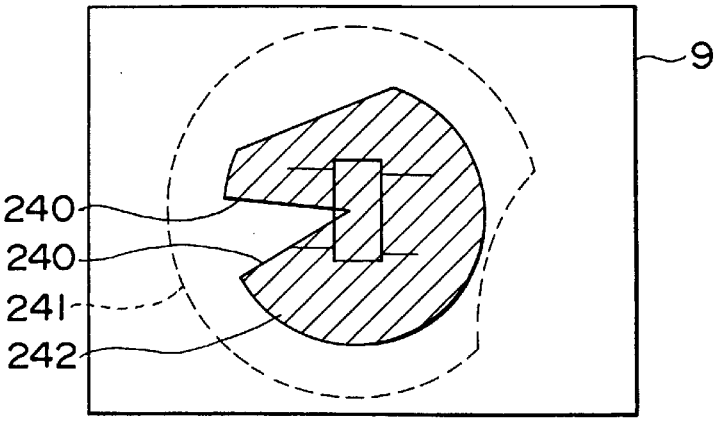
Figure 18:
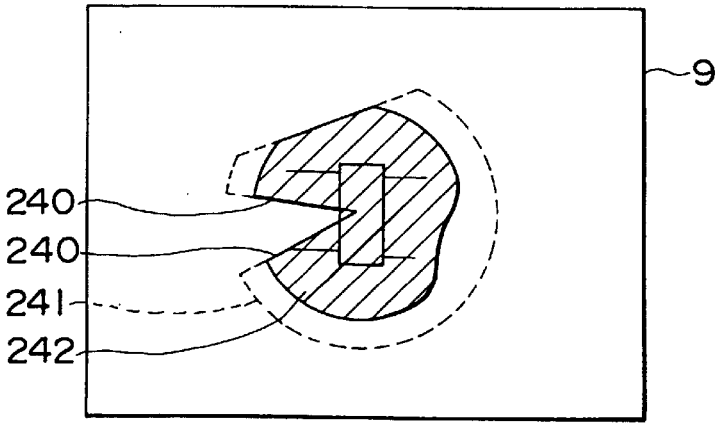
Figure 19:
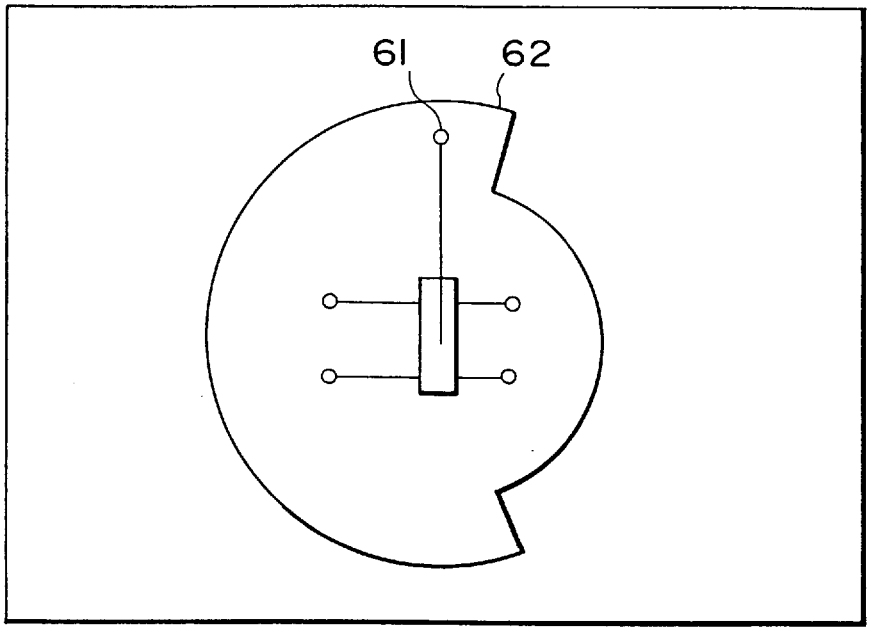
FIG. 19 PRIOR ART
FIG. 19 is an illustration of an example of indication of a movable range indicating apparatus in polar coordinates according to a prior art.
Figure 20:
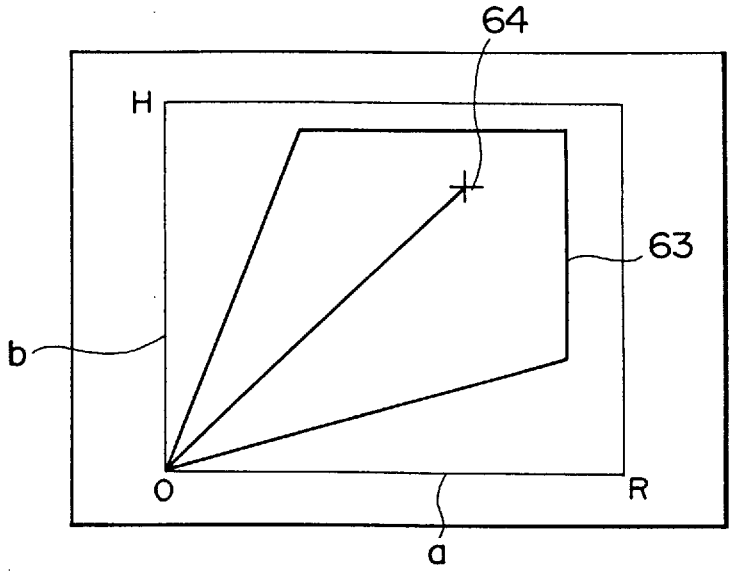
FIG. 20 PRIOR ART
FIG. 20 is an illustration of an example of the indication of a movable range indicating apparatus in rectangular coordinates according to another prior art.

FIGS. 16 to 18 illustrates changes in the movable range when the suspended load is different, in which numeral 240 denotes a turning limit, numeral 241 denotes a rated operating radius due to the current suspended load, and numeral 242 (a diagonally shaded area) denotes a movable range. Incidentally, the dotted-line areas of the turning limit 240 and the rated operating radius 241 mean limits beyond the movable range 242. Therefore, the operator can easily perform an operation corresponding to the movable range 242, which is changed by the suspended load. In addition, an interference with an obstacle can be prevented by dealing with it beforehand.

INDUSTRIAL APPLICABILITY

The present invention is useful as a movable range indicating apparatus for a mobile crane vehicle which enables an accurate and prompt judgement, and which can be easily operated with safety since a telescopic boom end position, a rated operating radius or a predetermined movable range, and a target point, as necessary, are indicated on the rectangular coordinates or on the polar coordinates by superimposition.

I claim:

1. A movable range indicating apparatus which is suitable for use on a mobile crane vehicle having a base carrier, a revolvable superstructure which is revolvably mounted on the base carrier, and a vertically swingable telescopic boom which is mounted to the revolving superstructure, said apparatus comprising:

a boom length detecting means, for detecting a length of the telescopic boom;

a boom angle detecting means, for detecting a derricking angle of the telescopic boom;

a load detecting means, for detecting an actual load acting on the telescopic boom;

a turning position detecting means, for detecting a turning position of the telescopic boom;

an operating condition inputting means, for inputting operating conditions of the revolvable superstructure and the base carrier;

a display section, capable of indicating images in rectangular coordinates in which said turning position is taken as an X-coordinate and an operating radius is taken as a Y-coordinate; and a control section, for performing calculations based on signals from each of said means, and for outputting calculation results to said display section;

wherein said control section calculates a current actual load, a rated operating radius for each turning position in a state of suspending said actual load, and an end position of the telescopic boom; and wherein said display section indicates an image of said rated operating radius and an image of the end position of said telescopic boom at corresponding positions on said rectangular coordinates by superimposition.

2. A movable range indicating apparatus in accordance with claim 1, wherein said operating condition inputting means comprises at least one operating condition detecting means for detecting an operating condition.

3. A movable range indicating apparatus in accordance with claim 1, further comprising a target point setting means, for setting a target point of a distal end of the telescopic boom; and wherein said target point is indicated on said display section by superimposition.

4. A movable range indicating apparatus in accordance with claim 3, wherein an enlargement of said target point and its neighborhood is indicated on said display section.

5. A movable range indicating apparatus which is suitable for use on a mobile crane vehicle having a base carrier, a revolvable superstructure which is revolvably mounted on the base carrier, and a vertically swingable telescopic boom which is mounted to the revolving superstructure, said apparatus comprising:

a boom length detecting means, for detecting a length of the telescopic boom;

a boom angle detecting means, for detecting a derricking angle of the telescopic boom;

a load detecting means, for detecting an actual load acting on said telescopic boom;

a movable range setting means;

a turning position detecting means, for detecting a turning position of the telescopic boom;

an operating condition inputting means, for inputting operating conditions of the revolving superstructure and the base carrier;

a display section, capable of indicating images in rectangular coordinates in which a turning angle is taken as the X-coordinate and an operating radius is taken as the Y-coordinate; and a control section, for performing calculations based on signals from each of said means, and for outputting calculation results to said display section;

wherein said control section calculates a current actual load, a rated operating radius for each turning position in a state of suspending said actual load, a limit operating radius obtained by comparing said rated operating radius with an operating radius limit value based on said movable range setting means, and an end position of the telescopic boom; and wherein said display section indicates an image of either said rated operating radius or said limit operating radius, and an image of the end position of said telescopic boom at the corresponding positions on said rectangular coordinates by superimposition.

6. A movable range indicating apparatus in accordance with claim 5, wherein said operating condition inputting means comprises at least one operating condition detecting means for detecting an operating condition.

7. A movable range indicating apparatus which is suitable for use on a mobile crane vehicle having a base carrier, a revolvable superstructure which is revolvably mounted on the base carrier, and a vertically swingable telescopic boom which is mounted to the revolving superstructure, said apparatus comprising:

a boom length detecting means, for detecting a length of the telescopic boom;

a boom angle detecting means, for detecting a derricking angle of the telescopic boom;

a load detecting means, for detecting a load acting on said telescopic boom;

an operating condition inputting means, for inputting operating conditions of the revolving superstructure and the base carrier;

a movable range setting means, capable of setting movable ranges for at least a lift of the telescopic boom, an operating radius, and said derricking angle;

a display section, capable of indicating images in rectangular coordinates, in which said operating radius is taken as an X-coordinate and the lift of said telescopic boom is taken as a Y-coordinate; and a control section, for performing calculations based on signals from each of said means, and for outputting calculation results to said display section;

wherein said control section calculates an actual load in a current attitude of the telescopic boom, a rated operating radius under said actual load, and an end position of the telescopic boom; and wherein said display section indicates an image of an end position of said telescopic boom, an image of said movable ranges, and an image of said rated operating radius at the corresponding positions on said rectangular coordinates by superimposition.

8. A movable range indicating apparatus in accordance with claim 7, wherein said operating condition inputting means comprises at least one operating condition detecting means for detecting an operating condition.

9. A movable range indicating apparatus in accordance with claim 7, further comprising:

a cable length detecting means; and a hook lift calculating means, for calculating a lift of a hook based on a signal from said cable length detecting means; and wherein a lift position of said hook is indicated on said display section by superimposition.

10. A movable range indicating apparatus which is suitable for use on a mobile crane vehicle having a base carrier, a revolvable superstructure which is revolvably mounted on the base carrier, and a vertically swingable telescopic boom which is mounted to the revolving superstructure, said apparatus comprising:

a boom length detecting means, for detecting a length of the telescopic boom;

a boom angle detecting means, for detecting a derricking angle of the telescopic boom;

a turning position detecting means, for detecting a turning position;

a load detecting means, for detecting a load acting on said telescopic boom;

a movable range setting means;

a display section, capable of indicating images in polar coordinates in which a turning angle is taken in a circumferential direction and an operating radius is taken in a radial direction;

a control section, for performing calculations based on signals from each of said means, and for outputting calculation results to said display section;

a target point setting means, for setting a target point of an end of the telescopic boom;

wherein said control section calculates a current actual operating radius, a current actual load, a rated operating radius for each turning position in a state of suspending said actual load, and a limit operating radius obtained by comparing said rated operating radius with an operating radius limit value set by said movable range setting means;

wherein said display section indicates said actual operating radius and said limit operating radius at corresponding positions on said polar coordinates by superimposition; and wherein said target point is indicated on said display section by superimposition.

11. A mobile crane comprising:

a base carrier;

a revolvable superstructure which is revolvably mounted on the base carrier;

a vertically swingable telescopic boom which is mounted to the revolving superstructure;

a boom length detecting means, for detecting a length of the telescopic boom;

a boom angle detecting means, for detecting a derricking angle of the telescopic boom;

a load detecting means, for detecting an actual load acting on the telescopic boom;

a turning position detecting means, for detecting a turning position of the telescopic boom;

an operating condition inputting means, for inputting operating conditions of the revolvable superstructure and the base carrier;

a display section, capable of indicating images in rectangular coordinates in which said turning position is taken as an X-coordinate and an operating radius is taken as a Y-coordinate; and a control section, for performing calculations based on signals from each of said means, and for outputting calculation results to said display section;

wherein said control section calculates a current actual load, a rated operating radius for each turning position in a state of suspending said actual load, and an end position of the telescopic boom; and wherein said display section indicates an image of said rated operating radius and an image of the end position of said telescopic boom at corresponding positions on said rectangular coordinates by superimposition.

12. A mobile crane in accordance with claim 11, wherein said operating condition inputting means comprises at least one operating condition detecting means for detecting an operating condition.

13. A mobile crane in accordance with claim 11, further comprising a target point setting means, for setting a target point of a distal end of the telescopic boom; and wherein said target point is indicated on said display section by superimposition.

14. A mobile crane in accordance with claim 13, wherein an enlargement of said target point and its neighborhood is indicated on said display section.

15. A mobile crane comprising:

a base carrier;

a revolvable superstructure which is revolvably mounted on the base carrier;

a vertically swingable telescopic boom which is mounted to the revolving superstructure;

a boom length detecting means, for detecting a length of the telescopic boom;

a boom angle detecting means, for detecting a derricking angle of the telescopic boom;

a load detecting means, for detecting an actual load acting on said telescopic boom;

a movable range setting means;

a turning position detecting means, for detecting a turning position of the telescopic boom;

an operating condition inputting means, for inputting operating conditions of the revolving superstructure and the base carrier;

a display section, capable of indicating images in rectangular coordinates in which a turning angle is taken as the X-coordinate and an operating radius is taken as the Y-coordinate; and a control section, for performing calculations based on signals from each of said means, and for outputting calculation results to said display section;

wherein said control section calculates a current actual load, a rated operating radius for each turning position in a state of suspending said actual load, a limit operating radius obtained by comparing said rated operating radius with an operating radius limit value based on said movable range setting means, and an end position of the telescopic boom; and wherein said display section indicates an image of either said rated operating radius or said limit operating radius, and an image of the end position of said telescopic boom at the corresponding positions on said rectangular coordinates by superimposition.

16. A mobile crane in accordance with claim 15, wherein said operating condition inputting means comprises at least one operating condition detecting means for detecting an operating condition.

17. A mobile crane comprising:

a base carrier;

a revolvable superstructure which is revolvably mounted on the base carrier;

a vertically swingable telescopic boom which is mounted to the revolving superstructure;

a boom length detecting means, for detecting a length of the telescopic boom;

a boom angle detecting means, for detecting a derricking angle of the telescopic boom;

a load detecting means, for detecting a load acting on said telescopic boom;

an operating condition inputting means, for inputting operating conditions of the revolving superstructure and the base carrier;

a movable range setting means, capable of setting movable ranges for at least a lift of the telescopic boom, an operating radius, and said derricking angle;

a display section, capable of indicating images in rectangular coordinates, in which said operating radius is taken as an X-coordinate and the lift of said telescopic boom is taken as a Y-coordinate; and a control section, for performing calculations based on signals from each of said means, and for outputting calculation results to said display section;

wherein said control section calculates an actual load in a current attitude of the telescopic boom, a rated operating radius under said actual load, and an end position of the telescopic boom; and wherein said display section indicates an image of an end position of said telescopic boom, an image of said movable ranges, and an image of said rated operating radius at the corresponding positions on said rectangular coordinates by superimposition.

18. A mobile crane in accordance with claim 17, wherein said operating condition inputting means comprises at least one operating condition detecting means for detecting an operating condition.

19. A mobile crane in accordance with claim 17, further comprising:

a cable length detecting means; and a hook lift calculating means, for calculating a lift of a hook based on a signal from said cable length detecting means; and wherein a lift position of said hook is indicated on said display section by superimposition.

20. A mobile crane comprising:

a base carrier;

a revolvable superstructure which is revolvably mounted on the base carrier;

a vertically swingable telescopic boom which is mounted to the revolving superstructure;

a boom length detecting means, for detecting a length of the telescopic boom;

a boom angle detecting means, for detecting a derricking angle of the telescopic boom;

a turning position detecting means, for detecting a turning position;

a load detecting means, for detecting a load acting on said telescopic boom;

a movable range setting means;

a display section, capable of indicating images in polar coordinates in which a turning angle is taken in a circumferential direction and an operating radius is taken in a radial direction;

a control section, for performing calculations based on signals from each of said means, and for outputting calculation results to said display section;

a target point setting means, for setting a target point of an end of the telescopic boom;

wherein said control section calculates a current actual operating radius, a current actual load, a rated operating radius for each turning position in a state of suspending said actual load, and a limit operating radius obtained by comparing said rated operating radius with an operating radius limit value set by said movable range setting means;

wherein said display section indicates said actual operating radius and said limit operating radius at corresponding positions on said polar coordinates by superimposition; and wherein said target point is indicated on said display section by superimposition.

* * * * *